US007691798B1

(12) United States Patent
Nadolink et al.

(10) Patent No.: US 7,691,798 B1
(45) Date of Patent: Apr. 6, 2010

(54) COATING TO REDUCE FRICTION ON SKIS AND SNOW BOARDS

(75) Inventors: Richard H. Nadolink, Portsmouth, RI (US); Charles W. Henoch, Crantson, RI (US); Susan Yan, Fairport, NY (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 911 days.

(21) Appl. No.: 11/296,722

(22) Filed: Dec. 8, 2005

(51) Int. Cl.
*C10M 145/28* (2006.01)
*C10M 169/04* (2006.01)

(52) U.S. Cl. ..... 508/577; 508/110; 524/502
(58) Field of Classification Search ..... 508/577, 508/110; 524/502
See application file for complete search history.

(56) References Cited

U.S. PATENT DOCUMENTS 4,111,820 A * 9/1978 Conti ..... 508/154
5,342,617 A * 8/1994 Gold ..... 424/405
5,409,622 A * 4/1995 Chapman et al. ..... 508/137
5,498,276 A * 3/1996 Luk ..... 75/252

FOREIGN PATENT DOCUMENTS

EP 390541 A2 * 10/1990

* cited by examiner

*Primary Examiner*—Glenn Caldarola
*Assistant Examiner*—Jim Goloboy
(74) *Attorney, Agent, or Firm*—James M. Kasischke; Michael P. Stanley; Jean-Paul A. Nasser

(57) ABSTRACT

A polymer coating applied to a load bearing or contact surface of objects such as skis and snowboards is provided. The polymer coating is a drag reducing, water soluble long chain polymer such as polyethylene oxide. The polymer coating is applied to the contact surface of the object and dissolves into the thin layer of water that forms between the contact surface and a water-containing surface over which the object is passed. The polymer readily dissolves in the thin water layer, decreasing the friction between the contact surface of the ski or snowboard and the surface of the snow or ice.

19 Claims, No Drawings

COATING TO REDUCE FRICTION ON SKIS AND SNOW BOARDS

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention is directed to friction reducing polymer coatings.

(2) Description of the Prior Art

In recreational activities that involve moving an object that has a surface in contact with liquid water, ice or snow, friction between the surface of the object and the water, snow or ice creates an undesirable loss of speed and decrease in maneuverability. Moreover, additional force or power needs to be added to overcome the effects of these frictional losses. Lubricants are used to decrease the friction between the object surface and the water, snow or ice. In activities such as skiing or snowboarding, a coating of a wax or similar material is applied to the surface of the ski or snow board that is in contact with the snow or ice to reduce friction.

Various compositions of waxes have been used including lacquer-waxes and paraffin waxes. The waxes in general adhere well to the surface of the ski or snowboard, are moisture repellent, have a low adhesion to snow and are easily applied. U.S. Pat. No. 4,343,863 is directed to a drag-reducing ski wax that is particularly useful on ultra-high performance skis and is applied directly as an exterior coating to the ski running surface base layer that will come into direct friction contact with snow. A poly(alpha-olefin) is incorporated into a wax formulation to reduce ski drag.

All waxes, however, easily wear off ski surfaces and need to be frequently reapplied. Therefore, repeated applications of the wax to the contact surface are required. In addition, waxes sometimes require heating during application. In many instances, the wax must be applied to a completely dry surface. Thus, "in-the-field" application or re-application of wax coatings is difficult or impossible, in particular where the surface is moist.

In addition to applying waxes to the contact surface of a ski or snow board, the contact, surfaces, which are generally bonded to the ski body, can be modified to provide for a level of lubrication. For example, the contact surface can contain a lubricating filler, for example powdered graphite or molybdenum disulfide. U.S. Pat. No. 5,409,622 is directed to a surface lubricant that contains over 50 vol. % boron nitride (hexagonal), with the remainder of the composition being bonding agents comprised of single or mixed oxides or organics, the boron nitride composition being from about 36 wt. % to about 99 wt. %. This lubricant is suitable for topical applications in a thin layer to various sports objects. The lubricant can be applied in the form of a stick, paste or powder or be incorporated into waxes. While such particulate lubricants help to reduce drag between the ski running surface and the snow, the spaced apart particles do not provide a continuous lubricating surface. They also tend to easily wear off the ski surface due to friction with the snow.

Another type of lubricant that can be used to decrease friction and increase performance is a drag reducing polymer. Drag reducing polymers have been applied in many different types of applications where friction or frictional loss needs to be minimized. Drag reducing polymers have been applied to the interior of pipes and have resulted drag reductions of up to 80% using long chain polymers at concentrations in the 5 parts per million range. The Alaskan oil pipe line, for example, uses long chain polymers to reduce frictional drag. This reduction in frictional drag increases the amount of flow through the pipe, reducing the number of pumping stations required to transfer the oil through the pipe line. Polymer coatings are also used on razors to provide a lubricant between the skin and the blade. Lubricating polymer materials have also been used for crowd control. By spraying the lubricating polymer on a street or parking lot, walking or running across the surface would be impossible due to the lubricious surface created by the polymer, and anyone attempting to cross the surface on foot would fall down and have to crawl.

U.S. Pat. No. 4,093,268 is directed to a plastic drag reducing surfacing material containing a lubricating polymer. A ski surfacing plastic base layer is provided that acts as a rigid, plastic, non-water soluble matrix for the lubricating additives. A long carbon chain, thermoplastic, water soluble polymer is disposed and interdispersed with the plastic, non-water soluble matrix. The polymer slowly dissolves and leaches out of the surrounding plastic matrix upon contact with the microlayer of water from the snow or ice on which the ski moves, to form a liquid, polymer containing film. The film acts as a continuous, frictionless boundary lubricant to reduce drag and increase speed. This surface attempts to rely on the leaching of the lubricant from the plastic matrix in order to achieve the desired lubrication. The amount and rate of leaching, however, may provide an insufficient amount of lubrication.

Therefore, the need exists for a lubricant that can be easily and repeatedly applied in the field to a frictional contact surface. A sufficient amount and concentration of the lubricant is applied so that the lubricant is easily and readily available to provide a sufficient amount of lubrication.

SUMMARY OF THE INVENTION

The present invention is directed to a polymer coating applied to a load bearing or contact surface of devices such as skis and snowboards. The polymer coating is a drag-reducing, water-soluble, long chain polymer. Examples of suitable polymers include, but are not limited to, polyacrylamide, carboxy methyl cellulose, sodium carboxy methyl cellulose, polysaccharide, guar gum, vinyl pyridine, poly (ethylene oxide) and mixtures thereof. The polymer coating is applied to the appropriate surface or surfaces of the device using conventional application methods including spray coating. When the device is a ski or snowboard, the polymer activates when the contact surface of the ski or snowboard moves over a crystalline snow or ice surface, creating a thin layer of water between the contact surface and the snow or ice surface. The polymer readily dissolves in the thin water layer, decreasing the friction between the contact surface of the ski or snowboard and the surface of the snow or ice. This reduction in friction produces an increase in acceleration and velocity of the ski or snowboard.

DETAILED DESCRIPTION OF THE PREFERRED EMBODIMENT

Exemplary embodiments in accordance with the present invention are directed to lubricants that are applied to the contact or load bearing surfaces of objects or devices that come into operational contact with moisture-containing or water-containing surfaces such as liquid water, water droplets, water vapor, ice and snow. Friction reducing coatings in accordance with the present invention are applied to the surface of an object or device that is exposed to frictional forces during use of the object or device. Examples of objects or devices to which the friction reducing coating is applied include, but are not limited to, skis, snow boards, snow shoes, ice skates, sled, toboggans, kayaks, canoes, bobsleds, luges, snow shovels, snow mobiles, boats, snow plows and snow blowers.

In one exemplary embodiment, the present invention includes a friction reducing coating that includes a plurality of particulates of a water soluble long chain polymer that is mixed with a carrier solution. The carrier solution is selected so that the long chain polymer particulates are not soluble in the carrier solution. In addition, the carrier solution is selected so that upon application to the contact surface of the object for which lubrication is desired, a substantial amount of the carrier solution dissipates or evaporates, leaving the plurality of particulates of the water soluble long chain polymer on the contact surface of the object. Suitable carrier solutions include, but are not limited to, glycerin, isopropanol and combinations thereof.

In one embodiment, the long chain polymer has a generally linear structure and is selected to be soluble in a particular liquid. Preferably, the contact surface of the object is brought into contact with a water-containing surface, for example, water, ice or snow. The long chain polymer is selected to be soluble in water. Useful long chain polymers have between about 25 to about 225,000 carbons per molecule. Particularly useful polymers have average molecular weights of at least about 100,000, for example from about 100,000 to about 5,000,000. Suitable long chain water soluble polymers include, but are not limited to, polyacrylamide $(CH_2CHCONH_2)_n$, carboxymethyl cellulose, sodium carboxymethyl cellulose, polysaccharide (nine or more monosaccharides linked with glycosidic bonds), guar gum (galactose, mannose and protein), vinyl pyridine, polyethylene oxide and combinations thereof. Preferably, the long chain polymer is polyethylene oxide. Suitable methods for making the long chain polymers are known and available in the art.

As the object runs across the water-containing surface, a thin layer of water forms between the contact surface of the object and the water-containing surface. The particulates of the long chain polymer dissolve into the thin layer of water, providing a lubricating layer between the contact surface of the object and the water-containing surface. Therefore, the mixture of the carrier solution and the long chain polymer is formulated so that a sufficient amount of polymer goes into solution in the thin layer of water to provide the desired level of lubrication. In one embodiment, the amount of polymer mixed with the carrier solution is selected so that upon application the concentration of polymer in the thin layer is at least about 1 part per million (ppm). Alternatively, the amount of polymer mixed with the carrier solution is selected so that upon application the concentration of polymer in the thin layer of water is from about 3 ppm to about 100 ppm.

In one embodiment, a mixture of the carrier solution and the particulate long chain polymer is made such that the long chain polymer is present in the carrier solution at up to about 30% by weight. In another embodiment, the long chain polymer is present in the carrier solution at from about 10% up to about 25% by weight. Preferably, the long chain polymer is present in the carrier solution at about 20% by weight.

The long chain polymer and the size of the long chain polymer particles are selected so that a sufficient amount of the water soluble lubricating polymer goes into solution in a time frame that is compatible with the rate at which the object passes over the water-containing surface. In many applications, for example skis and snowboards, the object passes relatively quickly over snow and ice, and the rate at which the particles of the long chain polymer go into solution in the thin layer of water between the contact surface and the snow or ice is compatible with the rate of travel of the snow board or ski. In one embodiment, the particles of the long chain polymer are micrometer sized. In another embodiment, the size of each one of the particles of the long chain polymer is up to about 5 μm. Preferably, the size of each one of the long chain polymer particles is from about 1 μm to about 2 μm. At these particulate sizes, the dissolution times of the polymer match the time scales associated with the rate at which the contact surface passes over the water-containing surface.

In a method for reducing friction between a contact surface of an object and a water-containing surface in accordance with the present invention, the carrier solution and the plurality of particulates of the water soluble long chain polymer are mixed, and the resulting mixture is applied to the contact surface. The carrier solution dissipates or evaporates, leaving the long chain polymer. The contact surface is brought into contact with the water containing surface, and a thin water layer forms between the contact surface and the water-containing surface, for example during normal use of the object.

The mixture can be applied using any suitable method for applying a liquid mixture including applying as a liquid, for example with a paint brush or roller, or by dipping the contact surface in the mixture. The mixture could be impregnated on a cloth which is rubbed on the surface. The mixture could also be formed into a solid stick or powder and applied in a generally solid state. Preferably, the mixture is applied as an aerosol, for example by spraying on the contact surface.

In general, the applied mixture has a limited service life. This is caused by the polymer going into solution and other effects, for example frictional removal of the particles from the contact surface. Therefore, the mixture is reapplied. In one embodiment, the mixture is reapplied after each time that the contact surface is brought into contact with the water-containing surface, for example after each run down a ski slope.

While it is apparent that the illustrative embodiments of the invention disclosed herein fulfill the objectives of the present invention, it is appreciated that numerous modifications and other embodiments may be devised by those skilled in the art. Additionally, feature(s) and/or element(s) from any embodiment may be used singly or in combination with other embodiment(s). Therefore, it will be understood that the appended claims are intended to cover all such modifications and embodiments, which would come within the spirit and scope of the present invention.

What is claimed is:

1. A friction reducing coating consisting essentially of:

a plurality of particulates of a water soluble long chain polymer, wherein each one of the plurality of particulates is sized from about 1 μm up to about 5 μm; and a carrier solution containing the plurality of particulates of the water soluble long chain polymer;

wherein the plurality of particulates are not soluble in the carrier solution; and wherein the carrier solution is capable of substantial evaporation in standard outdoor conditions.

2. The coating of claim 1, wherein the long chain polymer has a molecular weight of at least about 100,000.

3. A friction reducing coating consisting essentially of:

a plurality of particulates of a water soluble long chain polymer, wherein each one of the plurality of particulates is micrometer sized; and a carrier solution containing the plurality of particulates of the water soluble long chain polymer;

wherein the plurality of particulates are not soluble in the carrier solution; and wherein the carrier solution is capable of substantial evaporation in standard outdoor conditions.

4. The coating of claim 1, wherein each one of the plurality of particulates is sized from about 1 μm up to about 2 μm.

5. The coating of claim 1, wherein the plurality of particles are present in the carrier solution at a concentration of from about 10% to about 25% by weight.

6. The coating of claim 1, wherein the plurality of particles are present in the carrier solution at a concentration of about 20% by weight.

7. The coating of claim 1, wherein the long chain polymer is selected from the group consisting of polyacrylamide, carboxymethyl cellulose, sodium carboxymethyl cellulose, polysaccharide, guar gum, vinyl pyridine, polyethylene oxide and combinations thereof.

8. The coating of claim 1, wherein the long chain polymer comprises polyethylene oxide.

9. The coating of claim 1, wherein the carrier solution comprises glycerin, isopropanol or combinations thereof.

10. A friction reducing coating consisting essentially of:

a plurality of micrometer-sized particulates of a water soluble long chain polymer having a molecular weight of at east about 100,000; and a carrier solution containing about 20% by weight of the plurality of particulates of the water soluble long chain polymer;

wherein the plurality of particulates are not soluble in the carrier solution; and wherein the carrier solution is capable of substantial evaporation in standard outdoor conditions.

11. The coating of claim 10, wherein the long chain polymer is selected from the group consisting of polyacrylamide, carboxymethyl cellulose, sodium carboxymethyl cellulose, polysaccharide, guar gum, vinyl pyridine, polyethylene oxide and combinations thereof.

12. The coating of claim 10, wherein the carrier solution comprises glycerin, isopropanol or combinations thereof.

13. The coating of claim 10, wherein each one of the plurality of particulates is sized from about 1 μm up to about 2 μm.

14. A method for reducing friction between a contact surface of an object and a water-containing surface, the method comprising:

providing a mixture consisting essentially of a carrier solution and a plurality of particulates of a water soluble long chain polymer wherein the plurality of particulates are not soluble in the carrier solution; and applying the mixture to the contact surface in such a way that the long chain polymer will be present during use in a water layer between the contact surface and the water containing surface in a concentration of at least about 1 part per million.

15. The method of claim 14, wherein said plurality of particulates are sized from about 1 μm up to about 2 μm of the long chain polymer having a molecular weight of at least about 100,000.

16. The method of claim 14, wherein said plurality of particles are provided in the carrier solution at a concentration of about 20% by weight.

17. The method of claim 14, wherein the long chain polymer comprises polyethylene oxide.

18. The method of claim 14, wherein the step of applying the mixture comprises applying the mixture as an aerosol.

19. The method of claim 14, further comprising reapplying the mixture to the contact surface after each time that the contact surface is brought into contact with the water-containing surface.

* * * * *

UNITED STATES PATENT AND TRADEMARK OFFICE

CERTIFICATE OF CORRECTION

PATENT NO. : 7,691,798 B1
APPLICATION NO. : 11/296722
DATED : April 6, 2010
INVENTOR(S) : Richard H. Nadolink, Charles W. Henoch and Susan Yan It is certified that error appears in the above-identified patent and that said Letters Patent is hereby corrected as shown below:

In the Claims

Column 5, Claim 10, line 4, change “at east” to --at least--.

Signed and Sealed this
Fourteenth Day of May, 2013

Teresa Stanek Rea
*Acting Director of the United States Patent and Trademark Office*

UNITED STATES PATENT AND TRADEMARK OFFICE

CERTIFICATE OF CORRECTION

PATENT NO. : 7,691,798 B1
APPLICATION NO. : 11/296722
DATED : April 6, 2010
INVENTOR(S) : Richard H. Nadolink, Charles W. Henoch and Susan Yan It is certified that error appears in the above-identified patent and that said Letters Patent is hereby corrected as shown below:

In the Claims

Column 5, line 31 (Claim 10, line 4) change “at east” to --at least--.

This certificate supersedes the Certificate of Correction issued May 14, 2013.

Signed and Sealed this
Eleventh Day of June, 2013

Teresa Stanek Rea
*Acting Director of the United States Patent and Trademark Office*